US006739781B2

(12) United States Patent
Maloney et al.

(10) Patent No.: US 6,739,781 B2
(45) Date of Patent: May 25, 2004

(54) SCRUBBING STRUCTURE

(75) Inventors: Edward J. Maloney, North Yorkshire (GB); Kelly A. Smith, East Troy, WI (US)

(73) Assignee: Seaquist Closures Foreign, Inc., Crystal Lake, IL (US)

( * ) Notice: Subject to any disclaimer, the term of this patent is extended or adjusted under 35 U.S.C. 154(b) by 0 days.

(21) Appl. No.: 10/127,317

(22) Filed: Apr. 22, 2002

(65) Prior Publication Data

US 2003/0198502 A1 Oct. 23, 2003

(51) Int. Cl.[7] ..... B05C 11/00; B43K 1/06; B65D 47/00

(52) U.S. Cl. ..... 401/266; 401/265; 401/263; 401/183; 222/549; 222/544

(58) Field of Search ..... 401/261, 263, 401/265, 266, 183, 184, 185, 186, 262, 280; 300/2, 20, 4, 5; 222/424.5, 544, 545, 546, 548, 549, 522, 525

(56) References Cited

U.S. PATENT DOCUMENTS 2,939,615 A * 6/1960 Lerner ..... 222/207
3,216,630 A * 11/1965 Stull ..... 401/263
3,597,097 A * 8/1971 Kellis ..... 401/280
4,974,984 A * 12/1990 Kafkis et al. ..... 401/268
5,078,158 A * 1/1992 Lemon et al. ..... 132/200
5,110,017 A * 5/1992 Braun ..... 222/520
5,715,977 A * 2/1998 Goncalves ..... 222/521
6,029,866 A 2/2000 Wood et al.
6,116,478 A * 9/2000 Storar et al. ..... 222/564

OTHER PUBLICATIONS

Drawings A–1 and A–2.

* cited by examiner

*Primary Examiner*—David J. Walczak
(74) *Attorney, Agent, or Firm*—Wood, Phillips, Katz, Clark & Mortimer

(57) ABSTRACT

A dispensing closure that has a cover which is provided with a scrubbing structure that includes protuberances. In a preferred embodiment, the scrubbing structure is a resilient flexible material which has been molded on a generally rigid base. The base is injection molded in an initial injection molding step from a first material, and the scrubbing structure is injection molded in situ in a subsequent molding step from a second material onto said first material to become bonded thereto.

8 Claims, 6 Drawing Sheets

SCRUBBING STRUCTURE

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to a system for dispensing a fluent material from a container.

BACKGROUND OF THE INVENTION AND TECHNICAL PROBLEMS POSED BY THE PRIOR ART

A variety of packages that include dispensing closure systems on containers have been developed for household products such as liquid laundry detergents and other materials. Such containers typically have a neck defining an open upper end on which is mounted the dispensing closure.

Products sold in such packages include dishwashing detergents, laundry detergents, and other types of liquids or fluent materials. The inventors of the present invention have discovered that it would be advantageous to provide a closure with a structure for accommodating scrubbing of an object to be cleaned with such fluent cleaning materials or products. For example, it would be desirable to provide a structure for assisting the scrubbing of laundry detergent into an article of clothing or assisting the scrubbing of a dish with a dishwashing detergent.

It would be desirable to provide a structure that could be incorporated with the closure so as to eliminate or minimize the need to use a separate scouring pad, brush, or the like. The use of a package with an integral scrubbing system would allow the consumer to minimize the number of cleaning implements in a kitchen, laundry room, or other room and to thereby minimize unsightly components and clutter.

The incorporation of a scrubbing structure as part of a closure would have the added benefit that, when the cleaning material has been used up and the container is empty, the container could be discarded along with the closure and integral scrubbing structure as a single item of trash, and the subsequent use of a new cleaning product package according to the present invention would necessarily provide a new, clean scrubbing structure that is not worn or dirty.

It would also be beneficial if such an improved dispensing closure could readily accommodate its manufacture from a variety of different materials. Further, it would be desirable if such an improved dispensing closure could be provided with a design that would accommodate efficient, high quality, large volume manufacturing techniques with a minimal product reject rate. Preferably, the improved dispensing closure should also accommodate high speed manufacturing techniques that produce products having consistent operating characteristics unit-to-unit with high reliability.

The present invention provides an improved dispensing closure which can accommodate designs having the above-discussed benefits and features.

SUMMARY OF THE INVENTION

According to the present invention, a dispensing closure is provided for an opening to a container. The closure includes a body for extending from the container around the container opening and defining a discharge aperture for communicating with the opening. The closure also includes a cover movable between (a) a closed position preventing flow from or out of the closure, and (b) an open position away from the closed position permitting flow from the closure. The body includes (a) a base which is molded from a desired material, and (b) a scrubbing structure which is molded from a material onto the base and bonded to the base to define protuberances for scrubbing.

In one presently contemplated form of the invention, the cover is a rotatable twist top which can be rotated to effect upward movement of the twist top to open the closure. The cover includes a base which is molded from polypropylene and is generally rigid. The twist top also includes a scrubbing structure molded from a soft material, such as a thermoplastic elastomer. In the preferred form, the base polypropylene material and the scrubbing structure thermoplastic elastomer material are bi-injection molded.

The scrubbing structure may be in the form of protuberances, including, inter alia, ribs or fingers. The ribs or fingers are preferably somewhat resilient and deflectable to assist in scrubbing the fluent material on an object to be cleaned.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

FIG. 4 shows the closure in the full open position;

DESCRIPTION OF THE PREFERRED EMBODIMENT

While this invention is susceptible of embodiment in many different forms, this specification and the accompanying drawings disclose only some specific forms as an example of the invention. The invention is not intended to be limited to the embodiments so described, and the scope of the invention will be pointed out in the appended claims.

For ease of description, most of the figures illustrating the invention show a dispensing closure system in the typical orientation that it would have at the top of a container when the container is stored upright on its bottom end, and terms such as upper, lower, horizontal, etc., are used with reference to this position. It will be understood, however, that the dispensing closure system of this invention may be manufactured, stored, transported, used, and sold in an orientation other than the position described.

The dispensing closure system of this invention is suitable for use with a variety of conventional or special containers having various designs, the details of which, although not illustrated or described, would be apparent to those having skill in the art and an understanding of such containers.

In the illustrated preferred embodiments of the invention described herein, the container per se forms no part of, and therefore is not intended to limit, the present invention. It will also be understood by those of ordinary skill that novel and non-obvious inventive aspects are embodied in the described exemplary closure system alone. In other embodiments that are not illustrated herein, some or all of the components of the closure system could be formed as a unitary part, or non-removable part, of the container so that the invention could be regarded in such a case as including at least the dispensing "closure" portion of such a container.

Figure 1:
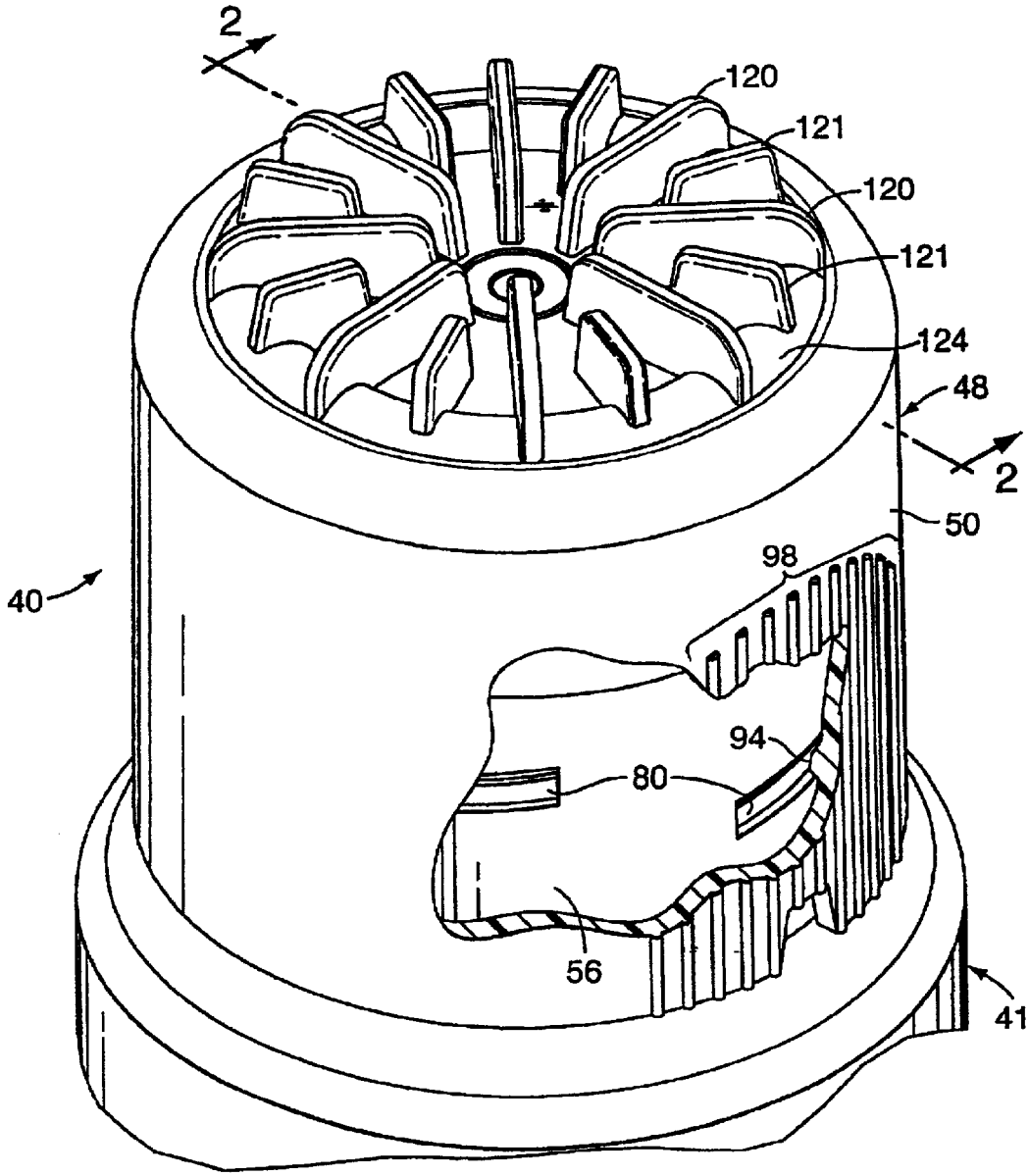
FIG. 1 is a fragmentary, perspective view of a closure of the present invention shown installed on a container, and the closure is shown in a closed condition.

A presently preferred first embodiment of a dispensing closure structure or dispensing closure system of the present invention is illustrated in FIGS. 1–5 and is designated generally therein by reference number 40 in FIG. 1. The dispensing closure system 40, which is hereinafter sometimes referred to more simply as the "closure 40," is, in the illustrated first embodiment, provided as a separately manufactured unit for mounting to the top of a container 41. It will be appreciated, however, that it is contemplated that in some applications it may be desirable for the dispensing closure system of the present invention to be formed as a unitary part, or extension, of a container.

The container 41 typically has a conventional mouth or opening 42 (FIG. 2) which provides access to the container interior and product contained therein. The product may be, for example, a fluent mixture cleaning product such as a laundry detergent or dishwashing detergent, or other liquid product. The product could also be another type of fluent material, including, but not limited to, fine particles, slurries, etc. Such materials may be sold, for example, as an industrial or household product, or other composition (e.g., for use in activities involving medicine, manufacturing, commercial or household maintenance, construction, agriculture, etc.).

The container 41 could may typically have a neck 43 (FIG. 2) or other suitable structure defining the container mouth 42. The neck 43 may have (but need not have) a circular cross-sectional configuration, and the body of the container may have another cross-sectional configuration, such as an oval cross-sectional shape, for example. The container 41 may, on the other hand, have a substantially uniform shape along its entire length or height without any neck portion of reduced size or different cross-section.

The illustrated embodiments of the closure are suitable for fluent materials which are intended to be merely poured from the container under the force of gravity without necessarily squeezing the container to force the fluent food material out. However, it is contemplated that the container could be a squeezable container having a flexible wall or walls which can be grasped by the user and compressed to increase the internal pressure within the container so as to squeeze the product out of the container through the closure 40 when the closure 40 is open. Such a container wall typically has sufficient, inherent resiliency so that when the squeezing forces are removed, the container wall returns to its normal, unstressed shape. Such a structure may be preferred in many applications, but may not be necessary or preferred in other applications. Indeed, the container may be substantially rigid. A piston could be provided in such a rigid container to aid in dispensing a product, especially a relatively viscous product. On the other hand, a rigid container could be employed for inverted dispensing of the contents solely under the influence of gravity and/or under the influence of a reduced ambient pressure exterior of the container.

Although the container, per se, does not necessarily form a part of the broadest aspects of the present invention, per se, it will be appreciated that at least a lower portion of the dispensing structure, system, or closure 40 of the present invention may be provided as a unitary portion, or extension, of the top of the container 41. However, in the preferred embodiment illustrated, the dispensing system or closure 40 is a separate closure element or assembly which is adapted to be removably or non-removably mounted to, or installed on, a previously manufactured container which has an opening to the container interior.

It is presently contemplated that preferred applications employing the closure 40 will be most conveniently realized by molding some or all of the components of the closure 40 from a suitable thermoplastic and/or thermoset material or materials. The closure components may be separately molded from the same material or from different materials. In a preferred embodiment, one of the components is bi-injection molded from two different materials. The materials may have the same or different colors and textures.

Figure 2:
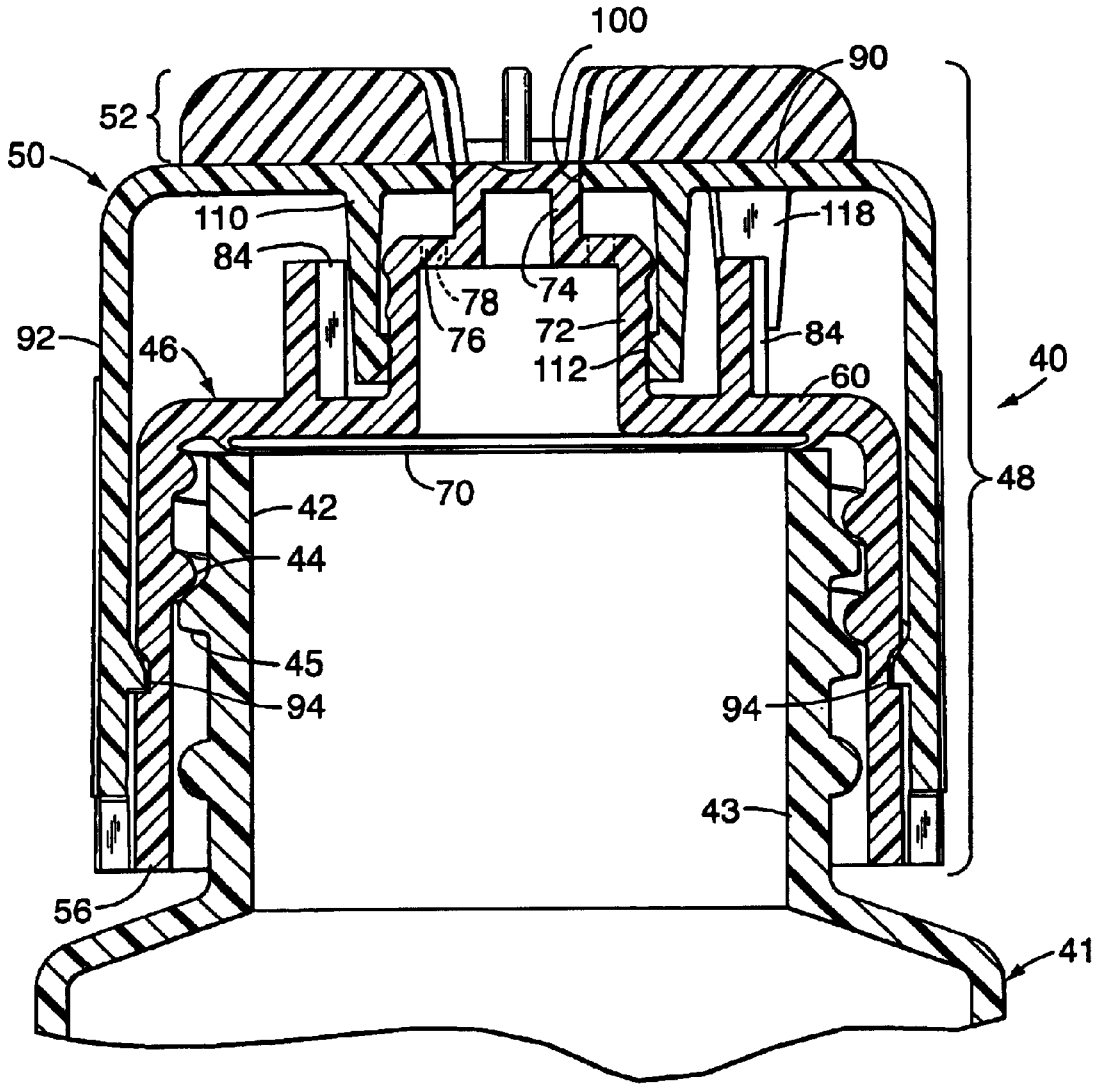
FIG. 2 is a fragmentary, cross-sectional view taken generally along the plane 2—2 in FIG. 1.

As can be seen in FIG. 2, the closure 40 includes a body 46 and a cover 48. In the preferred embodiment illustrated, the cover 48 is a twist top 48 comprising a base or shell 50 and a scrubbing structure 52.

The closure body 46 has a generally hollow, generally cylindrical skirt 56. As can be seen in FIG. 2, the interior of the closure body skirt 56 defines a female thread 44. The skirt 56 is adapted to receive the upper end of the container neck 43 which has a complementary male thread 45 to engage the closure body skirt thread 44.

Alternatively, the closure skirt 56 could be provided with some other container connecting means, such as a bead or groove (not illustrated) in place of the skirt thread 44 for engaging, respectively, a mating groove or bead (not illustrated) on the container neck. In another alternative (not illustrated), the closure body skirt 56 could have some other suitable connecting configuration so that, after the closure is molded, the closure skirt could be permanently fixed to a container by means of induction melting, ultrasonic melting, gluing, or the like, depending on the materials used for the container and closure body 46. With an appropriate design, the closure body 46 could also be molded as a unitary part of a container (e.g., by molding the closure and container together with the bottom of the container initially left open, then installing the additional dispensing closure component or components (e.g., twist top or lid), then inverting and filling the container through the open bottom, and finally subsequently closing the open bottom in a secondary operation (e.g., by applying a separate bottom closure cap to the bottom of the filled container)).

As shown in FIG. 2, the closure body 46 includes a deck 60 at the top of the skirt 56. The underside of the closure body deck 60 includes a downwardly projecting, annular, flexible, "crab's claw" type seal ring 70 (FIG. 2) which can sealingly engage the top annular surface or rim of the neck 43 of the container 41 to provide a leak-tight seal.

The container and closure 40 may be normally stored in the upright orientation wherein the closure 40 is at the top of the container. The closure 40 would typically be closed when the fluent product is not being dispensed from the container.

Figure 5:
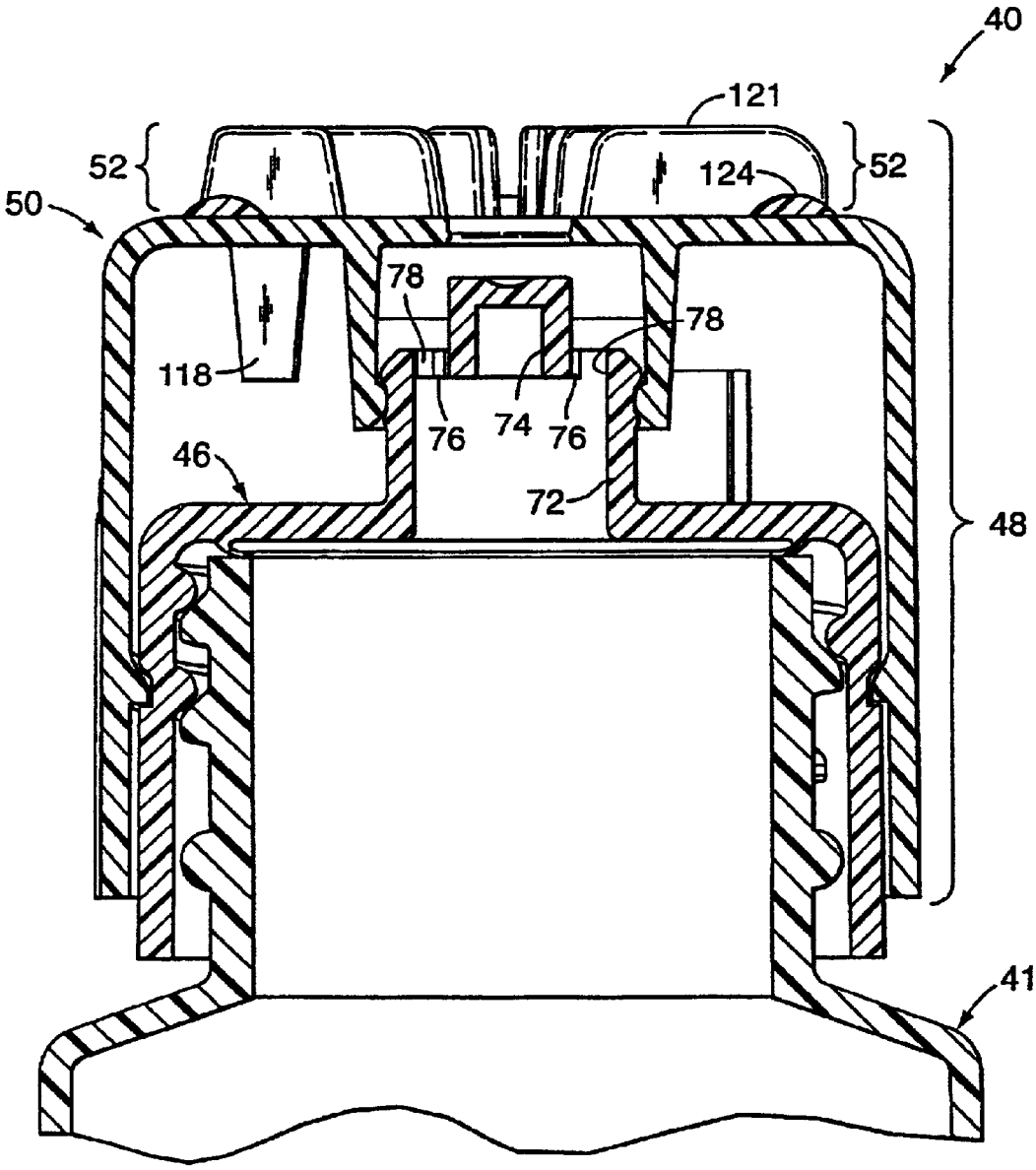
FIG. 5 is a cross-sectional view taken generally along the plane 5—5 in FIG. 3.

Projecting upwardly from the deck 60 of the body 46 is a reduced diameter spout 72 which includes a central post 74 at its upper end (FIGS. 2 and 5). The post 74 is supported across the upper end opening of the spout 72 by web portions 76 that define a plurality of dispensing passageways or discharge apertures 78 (FIG. 5).

As can be seen in FIG. 2, two posts or abutments 84 project upwardly from the closure body deck 60, and the abutments 84 are adapted to engage a fin or stop member 118 on the inside of the closure cover shell 50 as described hereinafter.

Figure 4:
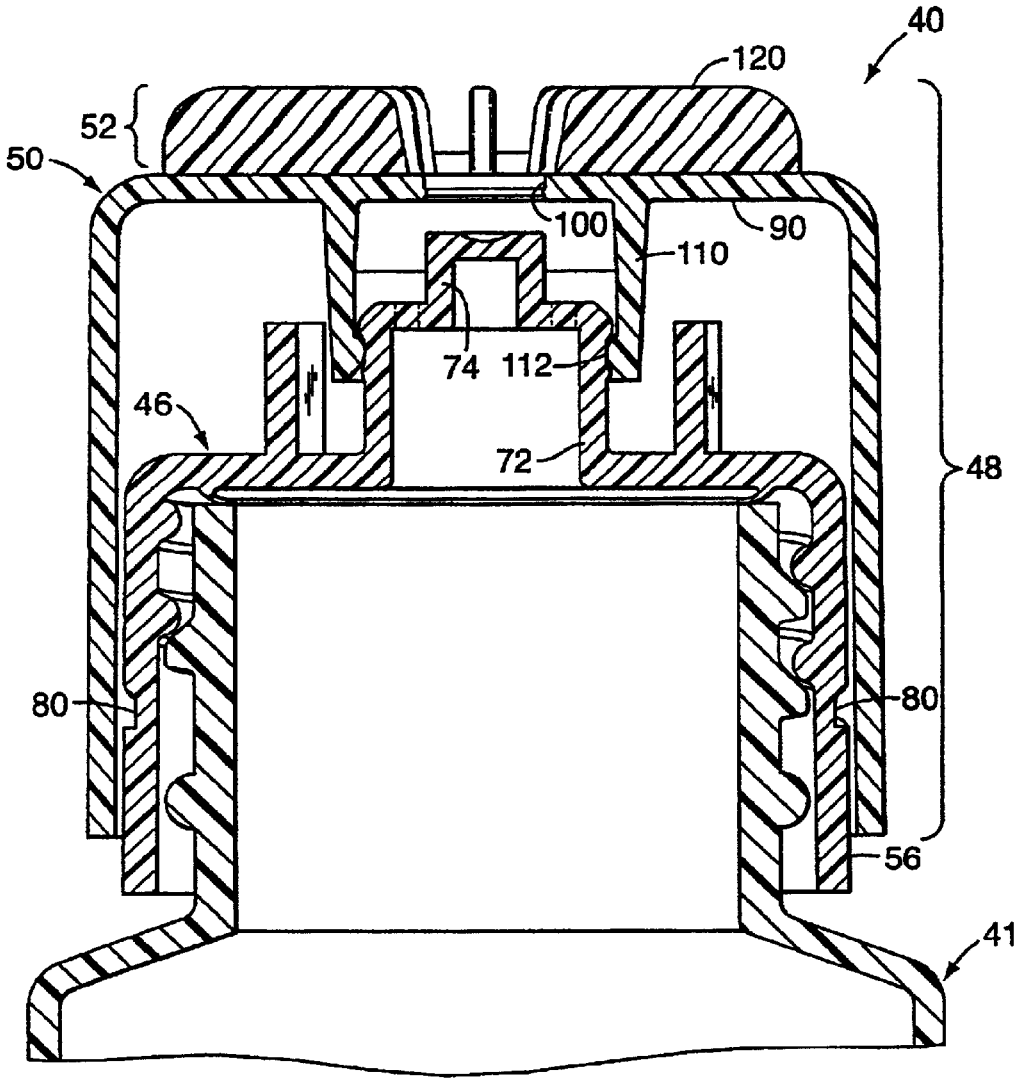
FIG. 4 is a is a cross-sectional view taken generally along the plane 4—4 in FIG. 3.

The skirt 56 of the closure body defines two arcuate cam channels 80 (FIGS. 1 and 4). Each arcuate cam channel has a generally helical configuration and extends in an arc of about 160 degrees. Each cam channel 80 is adapted to receive a cam follower rib 94 (FIG. 4) on the inside of the closure cover shell 50 as described hereinafter.

The shell 50 of the twist top 48, as shown in FIG. 2, includes a deck 90 and a peripheral skirt 92. The inside of the shell skirt 92 includes two, spaced-apart, helical ribs 94 which are each received in one of the closure body skirt cam channels 80. Each cam rib 94 extends for an arc of about 5 degrees.

Figure 3:
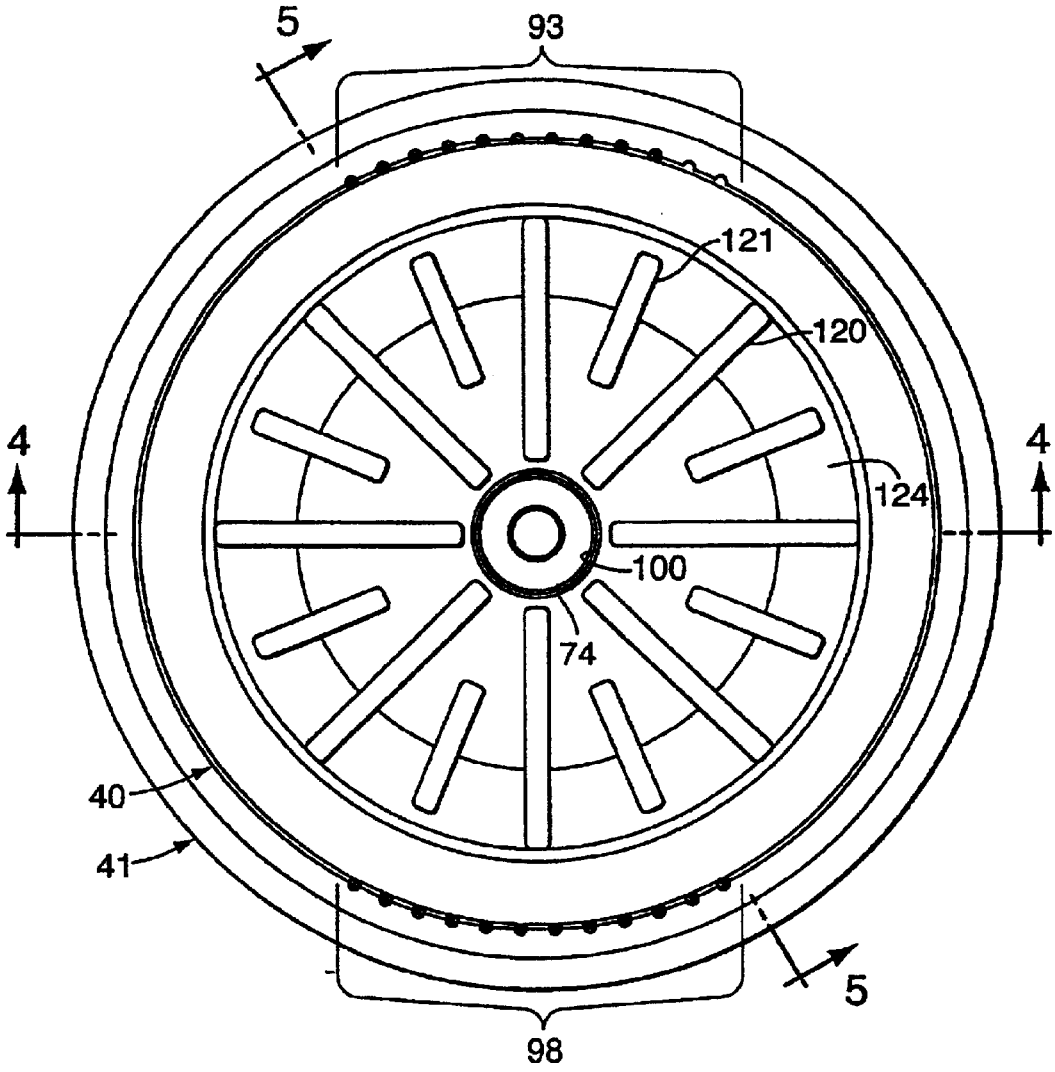
FIG. 3 is a top plan view of the closure in FIG. 1, but with the closure in the full open position.

The exterior of the twist top shell 50 includes two spaced-apart regions of gripping ribs or serrations 98 (FIGS. 1 and 3). The serrations or ribs 98 define gripping surfaces which may be grasped by the user (typically with a thumb on one of the regions 98 and with an index finger on the other of the regions 98) to assist the user in twisting the spout 48 in a clockwise direction or counterclockwise direction to close or open the closure 40.

The deck 90 of the twist top shell 50 defines a dispensing orifice 100 (FIG. 4) through which the product can flow when the twist top 48 is in the elevated, open position as illustrated in FIGS. 4 and 5. When the twist top 48 is in the lowered, closed position (FIG. 2), the deck 90 of the twist top shell 50 sealingly engages the closure body post 74 to occlude the dispensing opening or orifice 100.

On the interior of the twist top shell 50 there is an annular sealing wall 110 which projects downwardly from the twist top shell deck 90 (FIGS. 2 and 4). As can be seen in FIGS. 2 and 4, the lower end of the annular sealing wall 110 includes a sealing bead 112 for sealingly engaging the exterior surface of the closure body spout 72. This forms a sliding seal that accommodates vertical movement of the twist top 48 between the lowered, closed position (FIG. 2) and the elevated, fully opened position (FIGS. 4 and 5).

As can be seen in FIGS. 2 and 5, the stop member 118 projects downwardly from the twist top shell deck 90 on the interior of the shell 50. The stop member 118 engages one of the closure body abutments 84 at the fully closed position (FIG. 2) and engages the other of the closure body abutments 84 at the fully opened position.

Insofar as the closure 40 has been described, the closure body 46 and twist top base or shell 50 are generally conventional and incorporate a design that is in common use. However, according to the present invention, the unique combination of the base or shell 50 with the novel scrubbing structure 52 provides desirable advantages. The scrubbing structure 52 includes a plurality of protuberances. In the preferred embodiment illustrated in FIGS. 1–5, the protuberances are radially oriented ribs—longer ribs 120 and shorter ribs 121 (FIG. 1). The radially outer portion of each rib 120 and 121 extends from, and merges with, a generally annular bead 124 (FIGS. 1 and 5). In the preferred embodiment, the long ribs 120, short ribs 121, and bead 124 are all molded from the same, generally resilient, soft, flexible material which can be pressed against an object to be cleaned. Movement of the scrubbing structure 52 against the object to be cleaned in a scrubbing manner will temporarily, and elastically, deform the scrubbing structure 52, and this assists in the scrubbing action and in cleaning the object.

The scrubbing structure 52, in the preferred embodiment illustrated in FIGS. 1–5, is molded from a rubber-based, thermoplastic elastomer on the closure base portion or shell 50 of the twist top or cover 48. The shell 50 is preferably molded from a thermoplastic material such as polypropylene which is generally substantially rigid after it has been molded. Thus, the scrubbing structure, if it is molded from a rubber-based, thermoplastic elastomer, will be softer and somewhat flexible compared to the shell 50. In one form of the closure 40, the scrubbing structure 52 material can also be a different color than the color of the material used to form the shell 50 of the twist top 48.

In the presently preferred form of the closure 40, the twist top 48 is formed by a molding process such as bi-injection molding, two-shot molding, multi-injection molding, or over-molding. Descriptions of multi-shot, multi-material injection molding techniques are set forth in "Multi-Material Injection Saves Time, While Cutting Costs," MODERN PLASTICS, Mar. 19, 1994 (author: Peter Mapleston), in "Molding Many Parts Into One," Product Design and Development, Dec. 19, 1995, page 16 (author: Jay Rosenberg), and in U.S. Pat. No. 5,439,124. Also see the European Patent Publication No. 0 570 276 A1 which discloses how an internal mold element 12 can be repositioned to accommodate the molding of a second material into a ring 8 against a closure body previously molded from a first material.

Preferably, a bi-injection molding process is employed in the manufacture of the twist top 48 of the present invention. Specifically, the closure shell 50 (which does not include the scrubbing structure 52 per se) is molded as a first piece from a first material, such polypropylene, in a cavity of a mold assembly or tool. Part of the cavity is blocked with a removable or movable blocking member to prevent the hot, flowable polypropylene from filling the portion of the cavity where the scrubbing structure 52 will be subsequently located. The first material is then allowed to briefly cool somewhat.

Subsequently, the blocking member is moved or removed so as to expose the additional region of the mold cavity. The second material, such as a rubber-based, thermoplastic elastomer, is injected into the remaining vacant region of the cavity. This is allowed to cool to become attached or bonded to the first piece (i.e., the closure twist top base or shell 50) with a weld defined by the interface solidification of melted portions of the second and/or first materials. This creates the twist top 48 as a completed, bi-injected, molded structure may then be removed from the mold assembly. Subsequently, the twist top 48 can be mounted on a previously molded, or subsequently molded, closure body 46.

Although the twist top 48 is molded from (1) an initial (first) injection of material to form the base or shell 50, and (2) a subsequent (second) injection of material to form the scrubbing structure 52, the material employed in both the first injection and the second injection could be the same material. Typically, however, the scrubbing structure 52 is softer and more flexible than the shell 50, and the scrubbing structure 52 would contrast with the shell 50. This contrast may be effected by providing the scrubbing structure 52 with a different color.

The scrubbing structure 52 and the underlying shell 50 could be provided by using two different materials which may have the same color but wherein the scrubbing structure 52 is softer and/or more flexible than the shell 50 or has a different surface texture. Various textures may be molded into the surface of the scrubbing structure 52. Additionally, the scrubbing structure 52 may be provided with indicia molded directly into the material, and such indicia may include symbols, words, logos, etc.

The present invention also contemplates that a third material, or even more materials, may be molded with multi-injection processes to form a multi-material twist top 48. Alternatively, one material may be molded in three or more separate injections to provide a multi-injection molded twist top 48. Where the same material is employed in two or more injections, the material may have different colors for each of the different injections.

The closure body 46 can be separately molded in another mold assembly from a suitable material (e.g., polypropylene). Then the closure body 46 and the twist top 48 can be assembled together as the completed closure 40.

If desired, the closure body 46 may be formed as an integral or unitary part of the container. In such a design, the particular structure of the closure body 46 can be modified as necessary to be a simple, easily molded portion of the dispensing end of the container. This could be readily accomplished by molding the container with the bottom, non-dispensing, end of the container initially open. After the other dispensing closure components (e.g., a twist top, lid, or other cover) are mounted on the dispensing end of the container in a closed condition, and after the product has been introduced into the container through the open bottom end of the container, the open, bottom end of the container could be closed by one of a variety of suitable processes. For example, a separate, bottom end closure could be attached over the open bottom end of the container. Such a bottom end closure may be threadingly engaged, snap-fit engaged, adhesively secured, welded, or otherwise appropriately attached to the bottom end of the container.

Figure 6:
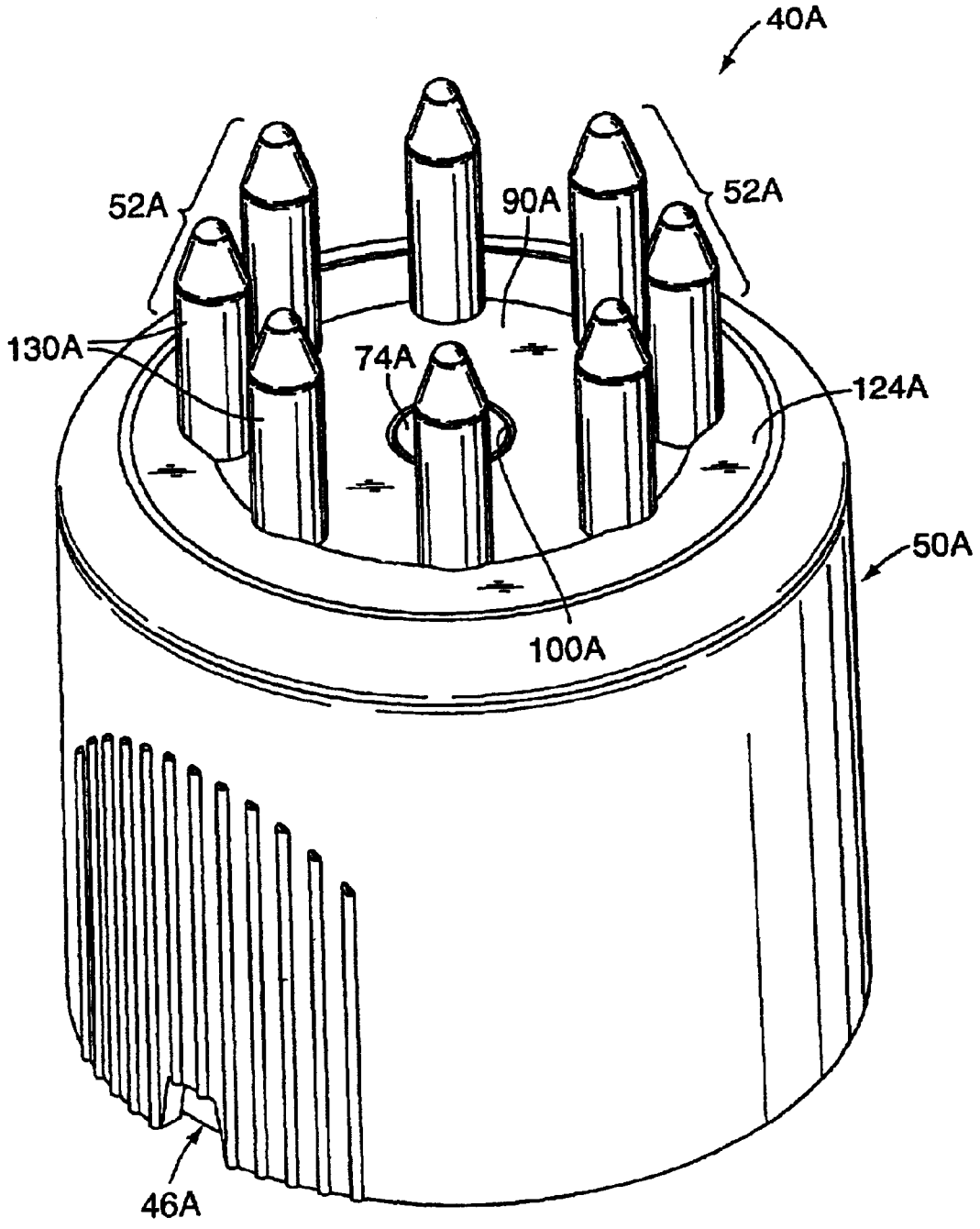
FIG. 6 is a perspective view of an alternate embodiment of the closure.

A second embodiment of the present invention is illustrated in FIG. 6 in the form of a closure and is designated therein generally by the reference number 40A. The closure 40A is a twist top type closure having a twist top shell 50A mount on an underlying closure body 46A (only a small portion of which is visible in FIG. 6). The closure body 46A and shell 50A each has a configuration which is substantially identical with the configuration of the first embodiment closure body 46 and shell 50, respectively, described above with respect to the first embodiment illustrated in FIGS. 1–5. In this respect, the second embodiment shell 50A has an annular top deck 90A defining a dispensing orifice 100A for being selectively occluded by a upstanding post 74A of the closure body 46A.

A scrubbing structure 52A is provided on the deck 90A of the shell 50A. The scrubbing structure 52A and the shell 50A together form the twist top. The scrubbing structure 52A includes a generally annular bead 124A and a circular array of a plurality of spaced-apart, generally elongate, upwardly projecting fingers 130A. Each finger 130A has a generally elongate cylindrical portion with an upper distal end having a generally frustoconical shape terminating in a somewhat blunt end or point. The bead 124A and fingers 130A are preferably formed from a resilient, flexible material. In the preferred form, the scrubbing structure 52A is molded from a thermoplastic elastomer. The same materials described above for the first embodiment scrubbing structure 52 may be employed for the second embodiment scrubbing structure 52A. The twist top shell 50A would typically be a more rigid material, such as polypropylene.

As with the first embodiment of the twist top 48 described above with reference to FIGS. 1–5, the second embodiment of the twist top is preferably bi-injection molded in a process wherein the shell 50A is molded as a first piece from a first material and wherein the scrubbing structure 52A is injection-molded onto the first material.

It will be appreciated that a scrubbing structure having configurations different from the first embodiment scrubbing structure 52 and different from the second embodiment scrubbing structure 52A may be employed in alternate embodiments. Further, the scrubbing structure may be employed on closures other than a twist top type of closure. For example, a scrubbing structure may be provided on the top of a hinged lid of a dispensing closure. For example, U.S. Pat. No. 4,545,495 discloses a dispensing closure having a hinged lid 18 with a flat top. A scrubbing structure in accordance with the present invention could be provided on the flat top of such a lid. U.S. Pat. No. 4,962,869 discloses another type of closure—a so-called disk top or toggle action closure wherein a disk-like actuator is provided with a generally flat top that can be pushed down at a location near a rear edge to pivot the actuator so that the front, dispensing end of the actuator projects upwardly in an open, dispensing position. At least portion of the top surface of such a disk-top actuator could be provided with a scrubbing structure in accordance with the teachings of the present invention.

The scrubbing structure may be incorporated on a closure structure that includes a pressure-actuatable slit valve, including but not limited to, a valve incorporating any of the designs disclosed in the U.S. Pat. No. 5,839,614. Such a valve could be mounted, for example, in the twist top dispensing orifice 100 shown in FIG. 4.

It will be readily observed from the foregoing detailed description of the invention and from the illustrations thereof that numerous other variations and modifications may be effected without departing from the true spirit and scope of the novel concepts or principles of this invention.

What is claimed is:

1. A dispensing closure for an opening to a container, said closure comprising:

a body for extending from said container around said opening and defining a discharge aperture for communicating with said opening; and a cover movable between (a) a closed position preventing flow from said closure, and (b) an open position moved away from said closed position permitting flow from said closure; said cover comprising (a) a base which is molded from a material, and (b) a scrubbing structure which is molded from a material onto said base and bonded to said base to define protuberances for scrubbing;

and wherein:

said cover is molded from a thermoplastic material; and said scrubbing structure is molded from a rubber-based, thermoplastic elastomer.

2. A dispensing closure for an opening to a container, said closure comprising:

a body for extending from said container around said opening and defining a discharge aperture for communicating with said opening; and a cover movable between (a) a closed position preventing flow from said closure, and (b) an open position moved away from said closed position permitting flow from said closure; said cover comprising (a) a base which is molded from a material, and (b) a scrubbing structure which is molded from a material onto said base and bonded to said base to define protuberances for scrubbing;

and wherein:

said cover base and scrubbing structure are molded from substantially the same material, except that said base has a color which differs from the color of said scrubbing structure.

3. A dispensing closure for an opening to a container, said closure comprising:

a body for extending from said container around said opening and defining a discharge aperture for communicating with said opening; and a cover movable between (a) a closed position preventing flow from said closure, and (b) an open position moved away from said closed position permitting flow from said closure; said cover comprising (a) a base which is molded from a material, and (b) a scrubbing structure which is molded from a material onto said base and bonded to said base to define protuberances for scrubbing;

and wherein:

said cover base is a generally rigid structure that is molded in an initial injection molding step from a first material; and said scrubbing structure is injection molded in situ in a subsequent molding step from a second material onto said first material so as to become bonded to said first material by interface solidification of melted portions of material.

4. A dispensing closure for an opening to a container, said closure comprising:

a body for extending from said container around said opening; said body defining central post and an adjacent discharge aperture for communicating with said opening; and a cover in the form of a twist top rotatably mounted on said body and axially movable between (a) a closed position preventing flow from said closure, and (b) an open position moved away from said closed position permitting flow from said closure; said cover including a base in the form of a shell having an annular deck defining a dispensing orifice which is occluded by said closure body post when said twist top is in said closed position and which is spaced away from said post when said twist top is in said open position;

said shell being a generally rigid structure that is molded in an initial injection molding step from a first material; said twist top further including a resiliently flexible scrubbing structure in the form of protuberances projecting above said shell annular deck; and said scrubbing structure having been injection molded in situ in a subsequent molding step from a second material onto said first material so as to become bonded to said first material by interface solidification of melted portions of material.

5. The closure in accordance with claim 4 in which said shell is molded from a thermoplastic material; and said scrubbing structure is molded from a rubber-based, thermoplastic elastomer.

6. The closure in accordance with claim 4 in which said closure body is a unitary molded element separate from, but attachable to, said container.

7. The closure in accordance with claim 4 in which said scrubbing structure includes radially oriented ribs and a peripheral bead of a resilient, flexible material.

8. The closure in accordance with claim 4 in which said scrubbing structure includes a circular array of spaced-apart, generally elongate fingers and a peripheral bead of a resilient flexible material.

* * * * *